US006904262B2

(12) United States Patent
Takahashi et al.

(10) Patent No.: US 6,904,262 B2
(45) Date of Patent: Jun. 7, 2005

(54) DOUBLE-FACED IMAGE FORMATION SYSTEM

(75) Inventors: Masaaki Takahashi, Kanagawa (JP); Keiji Yamamoto, Kanagawa (JP); Satoru Torimaru, Kanagawa (JP); Katsunori Kikuchihara, Kanagawa (JP); Yoko Miyamoto, Kanagawa (JP); Kiyotoshi Kaneyama, Kanagawa (JP); Satoshi Matsuzaka, Kanagawa (JP); Takashi Kawabata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 48 days.

(21) Appl. No.: 10/689,524

(22) Filed: Oct. 21, 2003

(65) Prior Publication Data

US 2005/0025542 A1 Feb. 3, 2005

Related U.S. Application Data

(60) Provisional application No. 60/509,810, filed on Oct. 10, 2003.

(30) Foreign Application Priority Data

Feb. 19, 2003 (JP) ..... 2003-041066

(51) Int. Cl.[7] ..... G03G 15/00; G03G 15/20; G03G 21/00

(52) U.S. Cl. ..... 399/390; 399/324; 399/341; 399/393; 399/409; 399/127; 399/128; 399/296; 118/60; 219/216

(58) Field of Search ..... 399/390, 324, 399/341, 393, 409, 127, 128, 296; 118/60; 219/216

(56) References Cited

U.S. PATENT DOCUMENTS

| | | | | | |
|---|---|---|---|---|---|
| 5,805,967 | A | * | 9/1998 | De Bock et al. | 399/299 |
| 5,983,066 | A | * | 11/1999 | Abe et al. | 399/394 |
| 6,101,345 | A | * | 8/2000 | Van Goethem et al. | 399/69 |
| 6,360,072 | B1 | * | 3/2002 | Costrop et al. | 399/325 |
| 6,775,507 | B2 | * | 8/2004 | Matsuura et al. | 399/297 |
| 6,801,746 | B2 | * | 10/2004 | Mills | 399/341 |

FOREIGN PATENT DOCUMENTS

JP 2000-267381 9/2000

* cited by examiner

*Primary Examiner*—Andrew H. Hirshfeld
*Assistant Examiner*—Marvin P. Crenshaw
(74) *Attorney, Agent, or Firm*—Morgan Lewis & Bockius LLP

(57) ABSTRACT

The invention provides a double-faced image formation system that prevents transfer and adhesion of a lubricant to an image retaining conveyer and an intermediate transfer part. The system is provided with, on a return path for reversing and conveying a sheet having toner images fixed on one side thereof, a front face electrifying unit and a rear face electrifying unit. Oil adhered on the rear face of the sheet in a fixation unit by the rear face electrifying unit is electrified to a negative polarity, and the oil adhered on the rear face is made impossible to transfer to an intermediate transfer belt. The oil adhered on the front face of the sheet in the fixation unit by the front face electrifying unit is electrified to a positive polarity, and the oil adhered on the front face is made impossible to transfer to a secondary transfer conveyance belt.

10 Claims, 4 Drawing Sheets

83
FRONT FACE ELECTRIFYING POWER SUPPLY
93
REAR FACE ELECTRIFYING POWER SUPPLY
105
OUTPUT INTER-FACE
100
101
CPU
RAM
103
ROM
102
104
INPUT INTER-FACE
41
UI
43
IMAGE DENSITY SENSOR
57
TEMPERATURE/HUMIDITY SENSOR

DOUBLE-FACED IMAGE FORMATION SYSTEM

The present application claims the benefit of U.S. Provisional Patent Application No. 60/509,810 filed Oct. 10, 2003.

BACKGROUND OF THE INVENTION

1. Field of the Invention

The present invention relates to a double-faced image formation system that forms images on both sides of a sheet, specifically to a type of double-faced image formation system that forms images on one side of a recording medium, and then forms images on the other side of the same recording medium.

2. Description of the Related Art

Conventionally, an image formation system is known, in which are disposed in parallel plural image formation units provided with image carriers (for example, photosensitive drums) on which toner images are formed and retained, an intermediate transfer belt is provided which moves to circulate along the direction of each image formation units being arrayed, the images of each color components (for example, yellow, magenta, cyan, black) formed by each image formation units are sequentially primarily transferred onto the intermediate transfer belt, and thereafter the images superposed on the intermediate transfer belt are secondarily transferred onto a sheet in a lump. Of this type of image formation system, a double-faced image formation system that forms images on both sides of a sheet is known, in which, when the double face mode is selected, the images superposed on the intermediate transfer belt (front face images) are secondarily transferred onto the front face of the sheet, the front face images are fixed by a fixation device, after the sheet is reversed by means of a sheet reversing conveying mechanism, the sheet is reconveyed to a secondary transfer unit, the images superposed on the intermediate transfer belt (rear face images) are secondarily transferred onto the rear face of the sheet, and the rear face images are fixed by the fixation device.

And, the fixation device provides a pair of fixation members that rotate in contact with each other (for example, a heating roll and a pressure roll to press in contact with the heating roll), and passes the sheet through a nipping area between the fixation members to thereby fix the yet-to-be-fixed toner images on the sheet. A conventional fixation device is known which provides an oil coating applicator to apply oil as a lubricant on the surface of the heating roll in order to prevent the so-called offset phenomenon that the toner on the sheet transfers to the heating roll (refer to Patent Reference 1).

[Patent Reference 1]

Japanese Published Unexamined Patent Application No. 2000-267381

In the double-faced image formation system using this sort of fixation device, if only the surface of the heating roll has the oil applied, since the heating roll and the pressure roll rotate in contact with each other before the fixation processing, the surface of the pressure roll will have the oil applied indirectly. Accordingly, when fixing the front face images (yet-to-be-fixed toner images) secondarily transferred on the front face of the sheet, there occurs a situation that the oil is transferred and adhered on the rear face (the face that comes in contact with the pressure roll) of this sheet. At that moment, the oil is electrified to the positive or negative polarity on the energy level of molecule in many cases. Under such a situation, if the sheet is reversed and the rear face images are secondarily transferred on the rear face of this sheet, the oil electrified to the reverse polarity to the toner will be transferred to the surface of the intermediate transfer belt from the rear face of the sheet by the function of the secondary transfer field. However, the oil is difficult to transfer to the area (image area) where the toner images are present on the intermediate transfer belt by the influence of the secondarily transferred toner; accordingly, the oil will transfer only to the area (non-image area) where the toner images are not present on the intermediate transfer belt.

Now, supposing a case that one double-faced image is sequentially formed to 1000 sheets, for example, the oil hardly transfers to the area corresponding to the image area, which exists on the same position on the intermediate transfer belt, but the oil sequentially transfers only to the area corresponding to the non-image area. As the quantity of the oil transferred to the intermediate transfer belt increases, the surface energy of the oil-adhered area on the intermediate transfer belt remarkably varies, which influences the transfer performance of the toner images. To explain this in detail, after executing the double-faced image formation sequentially multiple times as to one image, when an image different from the same image, especially a half-tone pattern image is formed on the whole area, the transfer efficiency in the oil adhered area (corresponding to the non-image area) on the intermediate transfer belt is enhanced in comparison to the other area. As the result, the rear face image formed on the formation of the double-faced image directly before appears faintly in a negative image in the half-tone image next formed, thus creating the so-called 'oil ghost' phenomenon.

The above Patent Reference 1 discloses a technique that installs a static eliminator in the sheet reversing conveying mechanism, eliminates static electricity from oil adhered on the front and rear faces of a sheet with images formed on the front face thereof, and thereby restrains the transfer and adhesion of the oil to the intermediate transfer belt.

However, even in the case of using the technique disclosed in the Patent Reference 1, there is a possibility that the oil adhered on the sheet will be transferred and adhered to the intermediate transfer belt, which proved that the technique was yet insufficient to prevent the above oil ghost as the measure. To be more concrete, the technique disclosed in the Patent Reference 1 definitely eliminates static electricity from the electrified oil to thereby remove an electrostatic factor. However, since the oil adhered to the sheet comes directly in contact with the intermediate transfer part (image retaining conveyer), it is confirmed that a physical adhesive force makes the oil transfer and adhere from the sheet to the intermediate transfer part (image retaining conveyer).

SUMMARY OF THE INVENTION

The present invention has been made in view of the above technical problems, and the invention provides a technique that prevents a lubricant adhered to a recording medium from transferring and adhering to the image retaining conveyer or the intermediate transfer part.

The invention also provides a technique that prevents a lubricant adhered to a recording medium from transferring and adhering to the transfer member.

After earnest examinations by the inventor, by supplying a lubricant with the electrostatic adhesive force that excels in the physical adhesive force, it was found that the lubricant could be retained on a recording medium. This brought the inventor to an idea to solve the above problems, which made up the invention.

According to one aspect of the invention, the double-faced image formation system includes an image retaining conveyer that conveys to retain toner images, a transfer part that electrostatically transfers the toner images retained on the image retaining conveyer onto a recording medium, a fixation part that has a pair of fixation members disposed in contact with pressure and a lubricant feed member that supplies a lubricant on surfaces of the fixation members, and fixes the toner images transferred to the recording medium, a reversing conveying part that reverses front and rear faces of the recording medium having the toner images fixed thereon by the fixation part, and conveys it toward the transfer part, and an electrifying part that, when the recording medium is conveyed by the reversing conveying part, electrifies the lubricant adhered on the recording medium to a specific polarity. Here, the electrifying part may electrify the lubricant adhered on the rear face of the recording medium on which the toner images are not fixed to the same polarity as an electrified polarity of the toner images. Further, the electrifying part may electrify the lubricant adhered on the front face of the recording medium on which the toner images are fixed to a reverse polarity to the electrified polarity of the toner images. And, the image retaining conveyer may convey to retain color toner images having toners of plural color components superposed thereon.

According to another aspect of the invention, the double-faced image formation system includes one or plural image retaining conveyers, an intermediate transfer part disposed to face to the image retaining conveyer, a primary transfer unit that transfers toner images on the image retaining conveyer to the intermediate transfer part, a secondary transfer unit that transfers toner images on the intermediate transfer part to a recording medium, a fixation unit that fixes toner images transferred on the recording medium to the recording medium, a lubricant supply unit that supplies a lubricant to the fixation unit, a conveyance unit that reverses the front and rear faces of the recording medium having the toner images fixed on one side thereof by the fixation unit, and reconveys it to the secondary transfer unit, and an electrifying unit that electrifies the recording medium conveyed on the conveyance unit. Here, the electrifying unit may include a pair of contact electrifying members that nip the recording medium. And, a magnitude of an electrifying bias applied to the recording medium by the electrifying unit may be determined on the basis of any one of the characteristics of the recording medium, image density of the toner images next recorded on the recording medium, and the environmental conditions. Further the electrifying unit may electrify the front and rear faces of the recording medium to different polarities. And, the lubricant may be amine-denatured silicon oil.

BRIEF DESCRIPTION OF THE DRAWINGS

Preferred embodiments of the present invention will be described in detail based on the followings, wherein:

FIG. 4A shows the case of this embodiment, and FIG. 4B shows the conventional case.

DESCRIPTION OF THE PREFERRED EMBODIMENTS

The preferred embodiment will now be described in detail with reference to the accompanying drawings.

Figure 1:
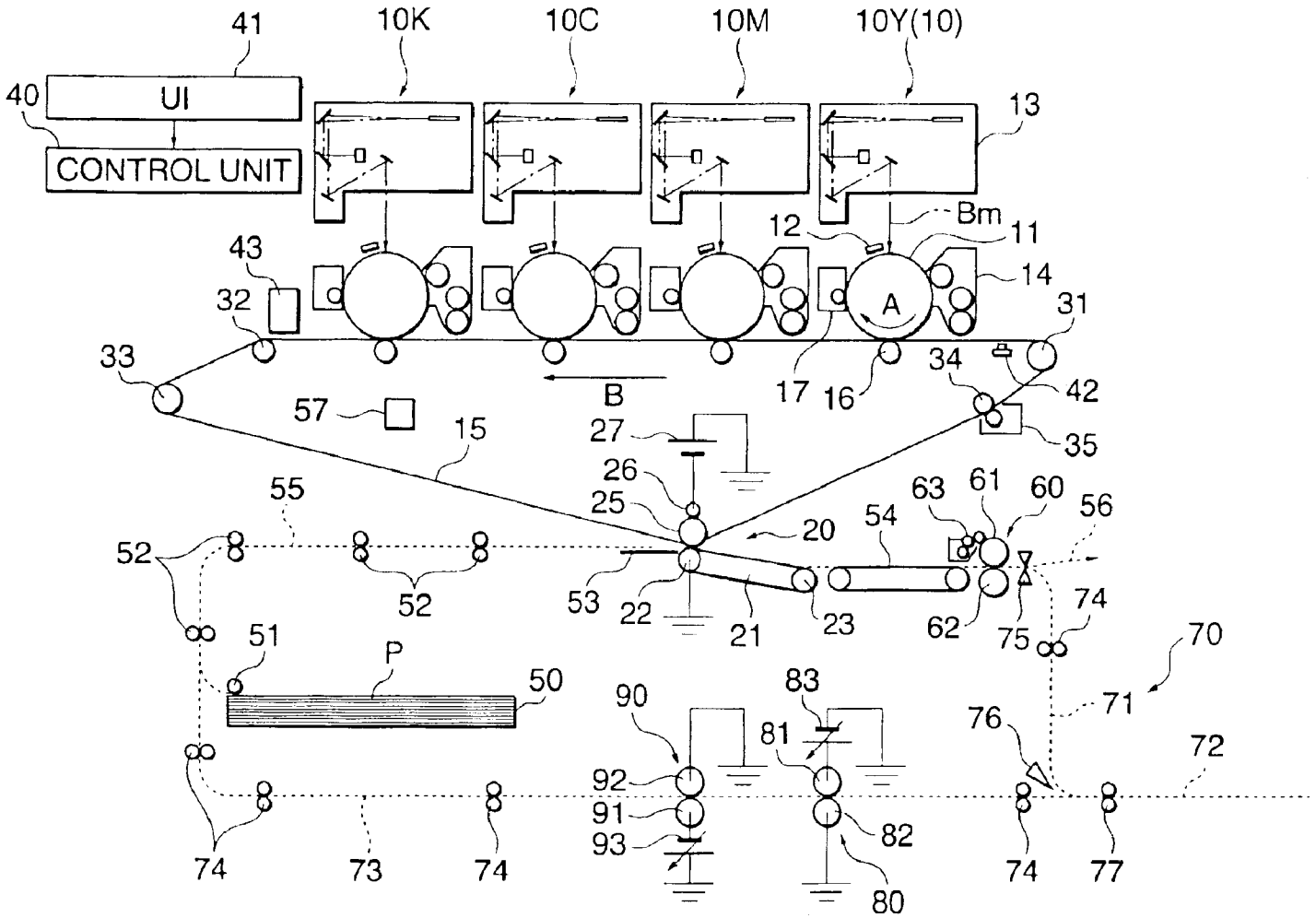
FIG. 1 illustrates an image formation system of the embodiment to which the invention is applied.

FIG. 1 illustrates an image formation system relating to this embodiment. The image formation system illustrated in FIG. 1 is the so-called tandem type, so-called intermediate decal type image formation system, which includes plural image formation units 10 (10Y, 10M, 10C, 10K) that form toner images of each color components by means of the electro-photographic system, an intermediate transfer belt (image retaining conveyer, intermediate transfer part 15 that allows the toner images of each colors formed by each of the image formation units 10 to be sequentially transferred (primary transfer) and retained thereon, a secondary transfer unit 20 that transfers in a lump the superimposed toner images transferred on the intermediate transfer belt 15 onto a sheet P being a recording medium, and a fixation unit 60 that fixes the secondary transferred images on the sheet P. Further, this image formation system includes a control unit 40 that controls the operations of each device (each unit) and a user interface UI 41 through which the instruction of operations by a user is implemented.

Each of the image formation units 10 (10Y, 10M, 10C, 10K) is provided with electro-photographic devices on the periphery of a photosensitive drum 11 as the image carrier that rotates in the direction of the arrow A, such as an electrifier 12 that electrifies the photosensitive drum 11, a laser exposure device 13 that writes electrostatic latent images into the photosensitive drum 11 (the exposure beams are shown by the symbol Bm in the drawing), a development device 14 that contains the toner of each color and makes visible the electrostatic latent images on the photosensitive drum 11 by the toner, a primary transfer roll 16 as the primary transfer unit that transfers the toner image of each color formed on the photosensitive drum 11 onto the intermediate transfer belt 15, and a drum cleaner 17 that cleans off a residual toner on the photosensitive drum 11, etc. These image formation units 10 are disposed substantially linearly in the order of yellow (Y) magenta (M), cyan (C), black (K). This embodiment uses the color toners that are electrified to the negative polarity.

The intermediate transfer belt 15 being the intermediate transfer part (image retaining carrier of the toner image) uses a polyimide or polyamide resin having an appropriate amount of the antistatic agent such as a carbon black contained therein. The intermediate transfer belt 15 is made such that the volume resistivity thereof is within $10^6$ to $10^{14}$ Ω·cm, and is formed in a film-like endless belt with a thickness of about 0.1 mm. The intermediate transfer belt 15 is driven to circulate at a specific speed by means of various rolls in the direction B illustrated in the drawing. The various rolls include a drive roll 31 that drives to circulate the intermediate transfer belt 15, which is driven by a motor exceeding in the constant speed performance (not illustrated), a support roll 32 that supports the intermediate transfer belt 15 extending substantially linearly along the direction of the photosensitive drums 11 being aligned, a tension roll 33 functioning as a compensation roll, which gives a constant tension to the intermediate transfer belt 15, and prevents meandering of the intermediate transfer belt 15, a backup roll 25 installed in the secondary transfer unit 20, and a cleaning backup roll 34 that scratches off a residual toner on the intermediate transfer belt 15.

Each of the primary transfer rolls 16 is arranged to face to each of the photosensitive drums 11 inside the intermediate transfer belt 15 extending substantially linearly. A voltage of reverse polarity to the electrified polarity of the toner (positive polarity in this embodiment) is applied to each of the primary transfer rolls 16. Thereby, the toner images on each of the photosensitive drums 11 are sequentially electrostatically attracted into the intermediate transfer belt 15, thus forming a superposed toner image on the intermediate transfer belt 15.

The secondary transfer unit 20 is made up with a secondary transfer conveyance belt 21 positioned on the toner image retaining side of the intermediate transfer belt 15, and the backup roll 25, etc. The backup roll 25 is made of a blended rubber tube of EDPM and NBR, the surface thereof has a carbon dispersed, and the inside thereof has an EDPM rubber contained. The backup roll 25 is formed such that the surface resistivity thereof is 7 to 10 log Ω/□, and the diameter thereof is 28 mm, and the hardness thereof is 70°, for example, (ASCOR type C) The backup roll 25 is positioned on the rear side of the intermediate transfer belt 15, and forms an electrode facing to the secondary transfer conveyance belt 21. A metal feed roll 26 to which a secondary transfer bias is stably applied is attached in contact with the backup roll 25.

On the other hand, the secondary transfer conveyance belt 21 is a semi-conductive endless belt having the volume resistivity of $10^6$ to $10^{10}$ Ω·cm, for example, which is stretched by a drive roll 22 and an idle roll 23. The secondary transfer conveyance belt 21 is driven by the drive roll 22, and is given a specific tension by the idle roll 23. The drive roll 22 is positioned to press the backup roll 25, in a state that the secondary transfer conveyance belt 21 and the intermediate transfer belt 15 are put between the two rolls, thus functioning as a secondary transfer roll that performs the secondary transfer to the sheet P carried on the secondary transfer conveyance belt 21. The feed roll 26 is connected to a power supply 27 for the secondary transfer bias, which applies a specific negative secondary transfer bias to the feed roll 26, and the drive roll 22 is grounded.

A belt cleaner 35 is located on the downstream viewing from the secondary transfer unit 20 of the intermediate transfer belt 15 so as to face to the cleaning backup roll 34 with the intermediate transfer belt 15 put in-between, which is in contact with and freely detachable from the intermediate transfer belt 15. The belt cleaner 35 removes residual toners or paper powders on the intermediate transfer belt 15 after the secondary transfer, and cleans the surface of the intermediate transfer belt 15. On the other hand, a reference sensor (home position sensor) 42 is located on the upstream of the yellow image formation unit 10Y, which generates a reference signal for making exact timings with the image formations in the image formation units 10 (10Y, 10M, 10C, 10K). An image density sensor 43 for regulating the image quality is located on the downstream of the black image formation unit 10K. The reference sensor 42 generates the reference signal on recognition of a specific mark attached on the rear side of the intermediate transfer belt 15. The image formation units 10 (10Y, 10M, 10C, 10K) are designed to start the image formations according to the instructions from the control unit 40 based on the recognition of the reference signal.

Further, this embodiment includes, as the sheet conveyance system, a sheet tray 50 that contains the sheet P, a pickup roll 51 that takes out the sheet P accumulated in the sheet tray 50 at a specific timing, and sends it out to a conveyance path 55, conveyance rolls 52 that convey the sheet P sent out by the pickup roll 51, a conveyance shoot 53 that sends the sheet P conveyed by the conveyance rolls 52 into the secondary transfer unit 20, and a conveyance belt 54 that conveys the sheet P toward the fixation unit 60 after the secondary transfer is performed by the secondary transfer conveyance belt 21. Further, the image formation system contains a temperature/humidity sensor 57 that measures the temperature and humidity inside thereof.

The fixation unit 60 includes a heating roll 61 installed rotatably, which incorporates a heating source not illustrated, a pressure roll 62 placed rotatably in contact with pressure to the heating roll 61, and an oil feeder (lubricant feeder, lubricant feed member) 63 that comes in contact with the heating roll 61 to supply oil (silicon oil) as a lubricant to the surface of the heating roll 61. The heating roll 61 and the pressure roll 62 constitute a pair of fixation member. Here, this embodiment uses amine-denatured silicon oil for the silicon oil, which has a significant affinity with a fluororubber and exhibits a high release property.

Especially, when the double face mode is selected, this embodiment provides a sheet reversing conveying mechanism 70 that reverses the sheet P having already completed one side of fixation by the fixation unit 60, and returns it again to the secondary transfer unit 20. This sheet reversing conveying mechanism 70 includes a branch path 71 branching downward against a discharge path 56 from the fixation unit 60, a reversing path 72 extending to the right, provided with the branch path 71, and a return path 73 formed to curve from this reversing path 72, which returns to the conveyance path 55 starting with the sheet tray 50; and these paths are connected to communicate with each other. The mechanism 70 provides these paths with an appropriate number of conveyance rolls 74, as the occasion arises. Further, the mechanism 70 provides a gate 75 on the exit of the fixation unit 60, which switches the conveyance direction of the sheet P after fixation into the discharge path 56 or the branch path 71, and provides a gate 76 on the branch point of the branch path 71 and the return path 73, which switches the conveyance direction of the sheet P to the right before reversing, or to the left after reversing. The reversing path 72 is also provided with a reciprocally rotatably switchback roll 77 attached thereon.

Further, the return path 73 is provided with, as the electrifying unit, a front face electrifying unit 80 that electrifies the front face (the face of the toner image having already been fixed) of the reversed conveyed sheet P, and a rear face electrifying unit 90 that electrifies the rear face (the face of the toner image being next formed) of the reversed conveyed sheet P on the downstream in the sheet conveyance direction of the front face electrifying unit 80. The front face electrifying unit 80 includes a front face electrifying roll 81 that is placed to come in contact with the front face of the sheet P, and a rear face roll 82 that is placed to face to the front face electrifying roll 81 and to come in contact with the rear face of the sheet P. Further, a front face electrifying power supply 83 applies a positive bias to the front face electrifying roll 81, and the rear face roll 82 is grounded. On the other hand, the rear face electrifying unit 90 includes a rear face electrifying roll 91 that is placed to come in contact with the rear face of the sheet P, and a front face roll 92 that is placed to face to the rear face electrifying roll 91 and to come in contact with the front face of the sheet P. Further, a rear face electrifying power supply 93 applies a negative bias to the rear face electrifying roll 91, and the front face roll 92 is grounded. Here, the front face electrifying roll 81, rear face roll 82, rear face electrifying roll 91, and front face roll 92 as the contact electrifying member can be selected appropriately among metal rolls, rubber rolls, and so forth.

Figure 2:
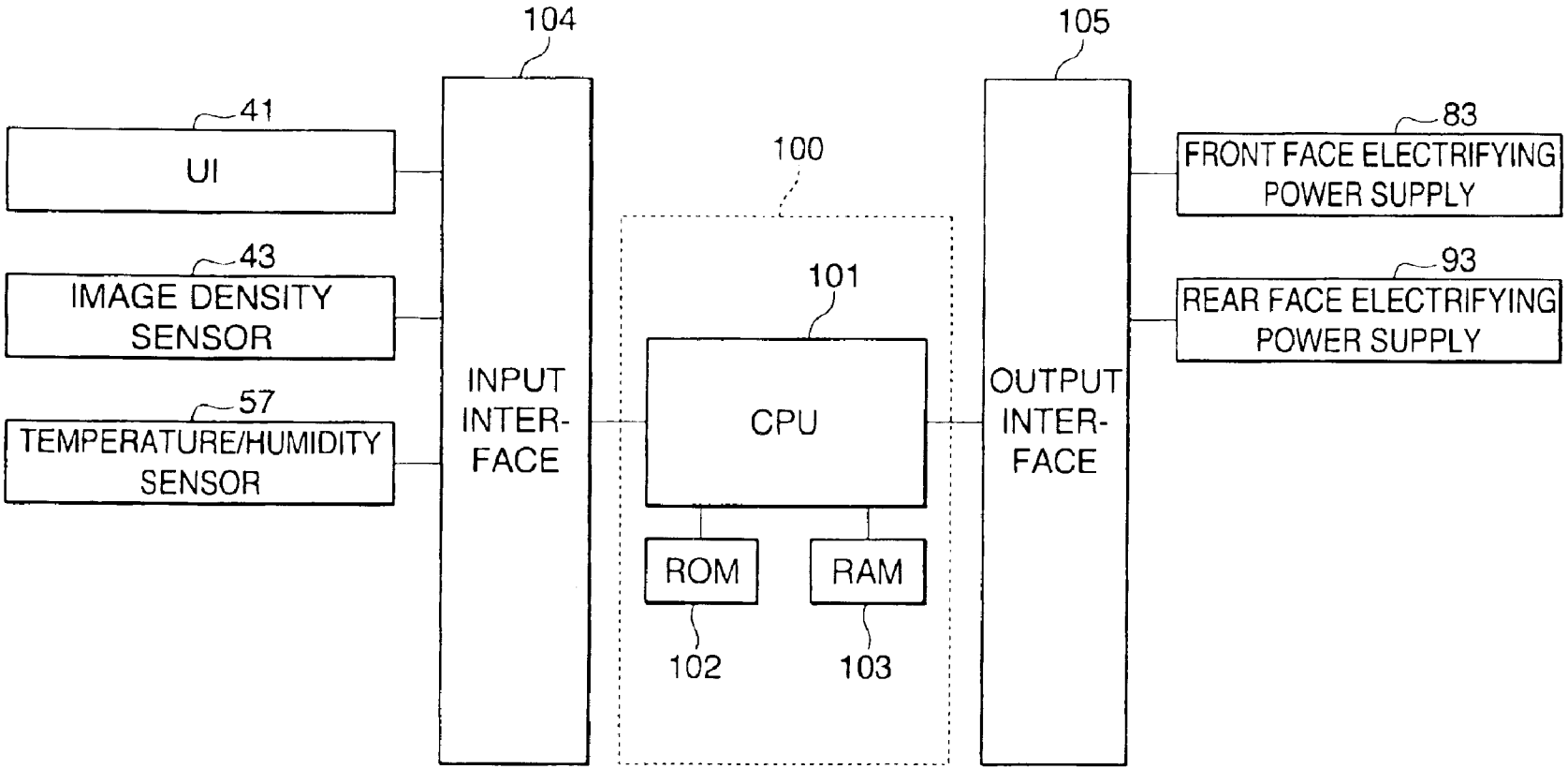
FIG. 2 is a block diagram illustrating a bias setting unit that sets electrifying biases by a front face electrifying unit and a rear face electrifying unit.

FIG. 2 illustrates a block diagram of a bias setting unit 100 that sets the electrifying biases by the front face electrifying unit 80 and the rear face electrifying unit 90. The bias setting unit 100 forms a function of the control unit 40. A CPU 101 of the bias setting unit 100 follows the program stored in a ROM 102, and executes the processing while exchanging data appropriately between the ROM 10.2 and a RAM 103. The bias setting unit 100 is supplied with information such as the sheet type, basic weight, and size of the sheet P inputted from the UI 41, the image density measured by the image density sensor 43, and the temperature/humidity measured by the temperature/humidity sensor 57, by way of an input interface 104. On the other hand, the bias setting unit 100 controls the magnitudes of the electrifying biases of the front face electrifying power supply 83 and the rear face electrifying power supply 93, by way of an output interface 105.

Next, the basic process of the image formation in the image formation system relating to this embodiment will be described. The image data outputted from an image reading device not illustrated, a personal computer not illustrated, and the like are inputted to the image formation system as illustrated in FIG. 1. The image formation system executes operations to form images by the image formation units 10, after completion of a specific image processing by an image processing system (IPS) not illustrated. The image processing system (IPS) executes to inputted reflectance data the given image processing of various image editing such as shading correction, position error correction, brightness/color space conversion, gamma correction, frame erasing and color editing, and motion editing, etc. The image data having the image processing applied thereto are converted into the color material gradation data of the four colors: yellow (Y), magenta (M), cyan (C), black (B), and the converted data are outputted to the laser exposure device 13.

The laser exposure device 13 irradiates, according to the color material gradation, for example, each of the photosensitive drums 11 of the image formation units 10Y, 10M, 10C, and 10K data with the exposure beams Bm emitted from a semiconductor laser. After the electrifier 12 electrifies the surface of each of the photosensitive drums 11 of the image formation units 10Y, 10M, 10C, and 10K, the laser exposure device 13 applies a scanning exposure to the surface thereof to form the electrostatic latent images. The electrostatic latent images formed are developed into the toner images of each of the colors: yellow (Y), magenta (M), cyan (C), and black (B), by the image formation units 10Y, 10M, 10C, and 10K.

The toner images formed on the photosensitive drums 11 of the image formation units 10Y, 10M, 10C, and 10K are transferred on the intermediate transfer belt 15 at respective positions where the photosensitive drums 11 come in contact with the intermediate transfer belt 15. To be more concrete, in the primary transfer unit, a voltage of the reverse polarity to the electrified polarity of the toners is applied to the base material of the intermediate transfer belt 15 at each of the primary transfer rolls 16, and the toner images not yet fixed are sequentially superposed on the surface of the intermediate transfer belt 15; thus, the primary transfer is carried out.

The yet-to-be-fixed toner images thus primarily transferred are conveyed to the secondary transfer unit 20 accompanied with the rotation of the intermediate transfer belt 15.

On the other hand, in the sheet conveyance system, the pickup roll 51 rotates in exact timings with the image formations to supply the sheet P of a specific size from the sheet tray 50. The sheet P supplied by the pickup roll 51 is conveyed on the conveyance path 55 by the conveyance rolls 52 to pass through the conveyance shoot 53 and reach the secondary transfer unit 20. Before reaching the secondary transfer unit 20, the sheet P is temporarily halted. In an exact timing with the move of the intermediate transfer belt 15 having the toner images retained thereon as mentioned above, a resist roll (not illustrated) rotates, whereby the sheet P is aligned with the toner images.

In the secondary transfer unit 20, the drive roll 22 presses the backup roll 25 through the semi-conductive secondary transfer conveyance belt 21 and the intermediate transfer belt 15. At that moment, the sheet P conveyed in an exact timing slides in between the intermediate transfer belt 15 and the secondary transfer conveyance belt 21. Here, as a voltage of the same polarity (negative polarity in this embodiment) with the electrified polarity of the toner is applied to the feed roll 26, a transfer field is generated with the secondary transfer conveyance belt 21 as the facing electrode, and the yet-to-be-fixed toner images retained on the intermediate transfer belt 15 are electrostatically transferred to the sheet P at the secondary transfer position where the yet-to-be-fixed toner images are pressed by the drive roll 22 and the backup roll 25.

Thereafter, the secondary transfer conveyance belt 21 conveys the sheet P having the toner images electrostatically transferred thereon, while it is peeled off the intermediate transfer belt 15, to the conveyance belt 54 provided on the downstream in the sheet conveyance direction of the secondary transfer conveyance belt 21. The conveyance belt 54 conveys the sheet P to the fixation unit 60 to keep pace with the optimum conveyance speed in the fixation unit 60. The yet-to-be-fixed toner images on the sheet P having been conveyed to the fixation unit 60 undergo fixation processing with heat and pressure by the fixation unit 60. Thereby, the yet-to-be-fixed toner images are fixed on the sheet P, and the sheet P with the fixed images formed is forwarded to the discharge path 56 according to the gate 75 to be discharged outside the system by a discharge roll (not illustrated). On the other hand, after completing the transfer to the sheet P, the residual toner remaining on the intermediate transfer belt 15 is conveyed to the cleaning unit with the rotation of the intermediate transfer belt 15, where the residual toner is removed from the intermediate transfer belt 15 by the cleaning backup roll 34 and the belt cleaner 35.

When the images are to be formed on both the faces of the sheet P, the front tip of the sheet P passed through the fixation unit 60 enters into the branch path 71 according to the gate 75. After conveyed on the branch path 71, the sheet P enters into the reversing path 72 according to the gate 76. After the sheet P is conveyed toward the inner part of the reversing path 72 by the switchback roll 77, the sheet P temporarily stops at the timing when the back tip of the sheet P has just passed the gate 76. Thereafter, the switchback roll 77 is reverse rotated at a specific timing, whereby the sheet P is now conveyed toward the reverse direction. The sheet P enters into the return path 73 according to the gate 76. After passing through the front face electrifying unit 80 and the rear face electrifying unit 90, the sheet P conveyed on the return path 73 is made to return to the conveyance path 55. Here, the front and rear faces of the sheet P is reversed to the state that the sheet P is initially placed on the conveyance path 55. And, according to the abovementioned process, the yet-to-be-fixed toner images are electrostatically transferred to the rear face of the sheet P this time, and are fixed by the fixation unit 60. The sheet P with the toner images fixed is discharged through the discharge path 56 to the outside of the system.

Figure 3:
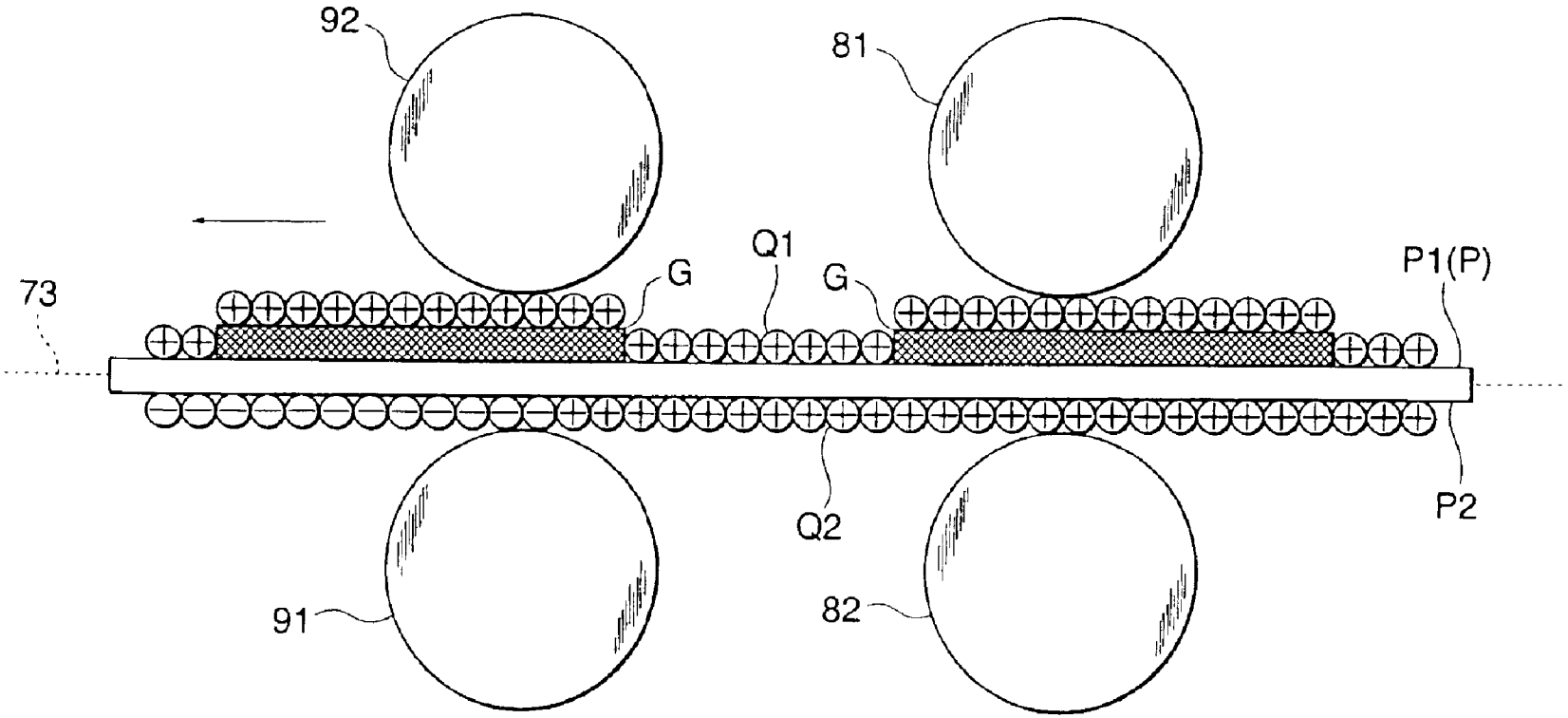
FIG. 3 is a typical illustration of a sheet with one side image already formed, which passes through the front face electrifying unit and the rear face electrifying unit.

Next, the operations of the front face electrifying unit 80 and the rear face electrifying unit 90 that are provided on the return path 73 will be described in detail. FIG. 3 typically illustrates the sheet P with an image already formed on one side, which passes through the front face electrifying unit 80 and the rear face electrifying unit 90 that are provided on the return path 73.

The sheet P with the images fixed on one side has oil Q adhered, when the sheet P passed the fixation unit 60 (see FIG. 1). Here in this description, the front side (the side with the toner image G already fixed) of the sheet P is called 'front face P1', and the backside (the side with the toner image G not yet formed) is called 'rear face P2'. As to the oil Q adhered to the sheet P, the oil adhered to the front face P1 is called 'front-face-adhered oil Q1', and the oil adhered to the rear face P2 is called 'rear-face-adhered oil Q2'.

The amine-denatured silicon oil used for the oil Q in this embodiment has the property that the oil is electrified to the positive polarity when it adheres to the sheet P. Accordingly, on the upstream side of the front face electrifying unit 80, both the front-face-adhered oil Q1 and the rear-face-adhered oil Q2 are electrified to the positive (the symbol '+' is attached in the drawing). When the sheet P passes through the front face electrifying unit 80, positive charges are injected from the front face electrifying roll 81 into the front-face-adhered oil Q1 adhered on the front face P1 of the sheet P, which further increases the positively electrified charges of the front-face-adhered oil Q1. When the sheet P passes through the rear face electrifying unit 90, negative charges are injected from the rear face electrifying roll 91 into the rear-face-adhered oil Q2 adhered on the rear face P2 of the sheet P, and the electrified polarity of the rear-face-adhered oil Q2 changes from the positive polarity into the negative (the symbol '−' is attached in the drawing) Therefore, after the sheet P passes through the front face electrifying unit 80 and the rear face electrifying unit 90, the front-face-adhered oil Q1 adhered on the front face P1 is electrified to the positive polarity, and the rear-face-adhered oil Q2 adhered on the rear face P2 is electrified to the negative polarity. That is, the front face P1 and the rear face P2 of the sheet P are to be electrified to different polarities.

Here, the bias setting unit 100 illustrated in FIG. 2 sets the magnitude of the front face electrifying bias applied by the front face electrifying power supply 83 of the front face electrifying unit 80, and the magnitude of the rear face electrifying bias applied by the rear face electrifying power supply 93 of the rear face electrifying unit 90. To explain this concretely, when receiving the information of sheet that the sheet P is thick paper from the UI 41, when receiving the information of image density that the image density is high from the image density sensor 43, and when receiving the information of environment that the ambient temperature and humidity are high from the temperature/humidity sensor 57, the bias setting unit 100 sets the absolute values of the front face electrifying bias and the rear face electrifying bias.

Figure 4B:
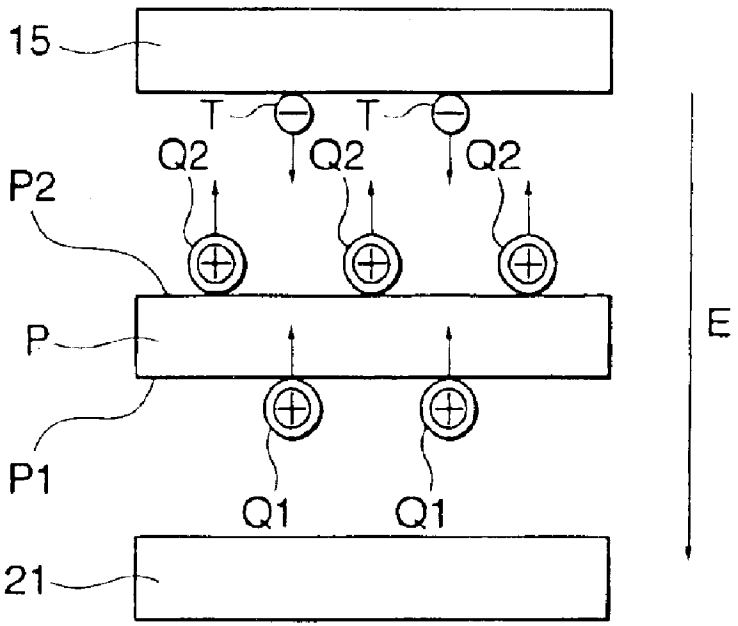
FIGS. 4A and 4B are typical illustrations of a sheet that is resent into the secondary transfer unit through a sheet reversing conveying mechanism.
Figure 4A:
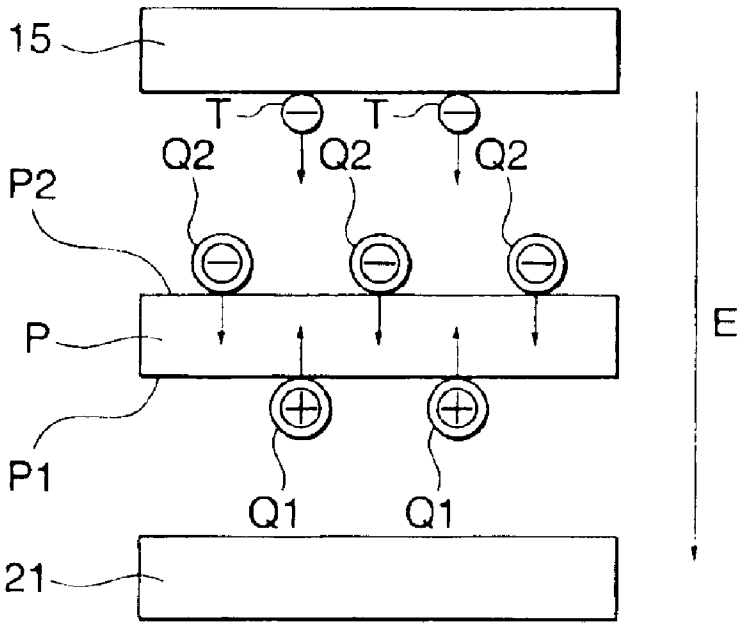

FIG. 4A typically illustrates the sheet P that is resent into the secondary transfer unit 20 through the sheet reversing conveying mechanism 70. In this embodiment, the toner T is electrified to the negative polarity, as mentioned above, the secondary transfer bias of the negative polarity is applied to the backup roll 25 (see FIG. 1) provided on the rear side of the intermediate transfer belt 15, and the drive roll 22 (see FIG. 1) provided on the rear side of the secondary transfer conveyance belt 21 is grounded; and thereby, a secondary transfer field E is generated, and this functions to transfer the toner T to the sheet P. Since the rear-face-adhered oil Q2 adhered on the rear face P2 of the sheet P facing to the intermediate transfer belt 15 is electrified to the negative polarity, the oil Q2 receives an electrostatic force directed toward the sheet P by the secondary transfer field E, thereby maintaining the state that the oil Q2 remains adhered on the sheet P. Therefore, the transfer and adhesion of the rear-face-adhered oil Q2 to the intermediate transfer belt 15 can be prevented. On the other hand, since the front-face-adhered oil Q1 adhered on the front face P1 of the sheet P facing to the secondary transfer conveyance belt 21 is electrified to the positive polarity, the oil Q1 receives an electrostatic force directed toward the sheet P by the secondary transfer field E, which also maintains the state that the oil Q1 remains adhered on the sheet P. Therefore, the transfer and adhesion of the front-face-adhered oil Q1 to the secondary transfer conveyance belt (transfer belt) 21 can be prevented as well.

FIG. 4B illustrates a case that does not contain the front face electrifying unit 80 and the rear face electrifying unit 90, namely, a conventional example in which the sheet P is resent into the secondary transfer unit 20 in a state that the front-face-adhered oil Q1 and the rear-face-adhered oil Q2 are electrified to the positive polarity. In this example, the rear-face-adhered oil Q2 is electrified to the positive polarity, and the oil Q2 receives an electrostatic force directed toward the intermediate transfer belt 15 by the secondary transfer field E. It is therefore understood that the oil Q2 is transferred and adhered to the intermediate transfer belt 15 from the rear face P2 of the sheet P.

In this embodiment, the rear-face-adhered oil Q2 adhered on the rear face P2 of the sheet P is electrified to the same polarity as the toner T (the reverse polarity to the electrified polarity of the oil Q), and thereafter the secondary transfer is executed to the rear face P2. Thereby, the transfer and adhesion of the rear-face-adhered oil Q2 to the intermediate transfer belt 15 can be restricted, and the occurrence of the oil ghost can be prevented.

In this embodiment, the front-face-adhered oil Q1 adhered on the front face P1 of the sheet P is electrified at a high level to the reverse polarity to the toner T (the same polarity as the electrified polarity of the oil Q), and thereafter the secondary transfer is executed to the rear face P2. Thereby, the transfer and adhesion of the front-face-adhered oil Q1 to the secondary transfer conveyance belt 21 can be restricted, and the occurrence of discrepancies accompanied with the adhesion of the oil Q to the secondary transfer conveyance belt 21 (for example, degradation of the secondary transfer conveyance belt 21, and difficulty in removing the toner adhered on the secondary transfer conveyance belt 21) can be prevented.

Further in this embodiment, since the front face electrifying unit 80 and rear face electrifying unit 90 use roll materials for the electrifying member, the system generates very little ozone and so forth, which proves the system safe.

And, in this embodiment, according to the information of the sheet P, image density formed, and temperature/humidity, the front face electrifying bias applied to the sheet P by the front face electrifying unit 80 and the rear face electrifying bias applied to the sheet P by the rear face electrifying unit 90 are designed to be adjustable appropriately. Therefore, the system is able to implement a satisfactory double-faced image formation, while selecting the conditions of obstructing the transfer and adhesion of the oil Q adhered on the sheet P to the intermediate transfer belt 15 and the secondary transfer conveyance belt 21.

In this embodiment, the tandem type image formation system has been described, however the invention is not limited to this. The invention is also applicable to the so-called four-cycle type image formation system, in which the intermediate transfer belts are placed to face to one photosensitive drum, and the toner images of each colors are sequentially formed on the photosensitive drum to be transferred and superposed sequentially on the intermediate transfer belts.

Also in this embodiment, the intermediate decal type image formation system has been described, however the invention is not limited to this. The invention is also applicable to a type of image formation system, in which four photosensitive drums are arranged in parallel, sheet conveyance belts are provided to face to each of these photosensitive drums, and the toner images formed on each of the photosensitive drums are sequentially transferred to the sheet conveyed on the sheet conveyance belts.

According to the invention, the transfer and adhesion of a lubricant adhered on a recording medium to the image retaining conveyer and the intermediate transfer part can be prevented.

The entire disclosure of Japanese Patent Application No. 2003-041066 filed on Feb. 19, 2003 including specification, claims, drawings and abstract is incorporated herein by reference in its entirety.

What is claimed is:

1. A double-faced image formation system comprising:

an image retaining conveyer that conveys to retain toner images;

a transfer part that electrostatically transfers the toner images retained on the image retaining conveyer onto a recording medium;

a fixation part that has a pair of fixation members disposed in contact with pressure and a lubricant feed member that supplies a lubricant on surfaces of the fixation members, and fixes the toner images transferred to the recording medium;

a reversing conveying part that reverses front and rear faces of the recording medium having the toner images fixed thereon by the fixation part, and conveys it toward the transfer part; and an electrifying part that, when the recording medium is conveyed by the reversing conveying part, electrifies the lubricant adhered on the recording medium to a specific polarity.

2. A double-faced image formation system according to claim 1, wherein the electrifying part electrifies the lubricant adhered on the rear face of the recording medium on which the toner images are not fixed to the same polarity as an electrified polarity of the toner images.

3. A double-faced image formation system according to claim 2, wherein the electrifying part further electrifies the lubricant adhered on the front face of the recording medium on which the toner images are fixed to a reverse polarity to the electrified polarity of the toner images.

4. A double-faced image formation system according to claim 1, wherein the image retaining conveyer conveys to retain color toner images having toners of plural color components superposed thereon.

5. A double-faced image formation system comprising:

one or plural image retaining conveyers;

an intermediate transfer part disposed to face to the image retaining conveyer;

a primary transfer unit that transfers toner images on the image retaining conveyer to the intermediate transfer part;

a secondary transfer unit that transfers toner images on the intermediate transfer part to a recording medium;

a fixation unit that fixes toner images transferred on the recording medium to the recording medium;

a lubricant supply unit that supplies a lubricant to the fixation unit;

a conveyance unit that reverses the front and rear face of the recording medium having the toner images fixed on one side thereof by the fixation unit, and reconveys it to the secondary transfer unit; and an electrifying unit that electrifies the recording medium conveyed on the conveyance unit.

6. A double-faced image formation system according to claim 5, wherein the electrifying unit includes a pair of contact electrifying members that nip the recording medium.

7. A double-faced image formation system according to claim 5, wherein a magnitude of an electrifying bias applied to the recording medium by the electrifying unit is determined on the basis of any one of characteristics of the recording medium, image density of toner images next recorded on the recording medium, and environmental conditions.

8. A double-faced image formation system according to claim 5, wherein the electrifying unit electrifies the front and rear faces of the recording medium to different polarities.

9. A double-faced image formation system according to claim 5, wherein the lubricant is amine-denatured silicon oil.

10. A double-faced image formation method comprising:

conveying to retain toner images by an image retaining conveyer;

electrostatically transferring the toner images retained on the image retaining conveyer onto a recording medium by a transfer part;

supplying a lubricant on surfaces of fixation members disposed in contact with pressure by a lubricant feed member, and fixing the toner images transferred to the recording medium;

reversing front and rear faces of the recording medium having the toner images fixed thereon by the fixation members by a reversing conveying part, and conveying it toward the transfer part; and electrifying the lubricant adhered on the recording medium to a specific polarity by an electrifying part when the recording medium is conveyed by the reversing conveying part.

* * * * *